US010850408B2

(12) United States Patent
Peters

(10) Patent No.: US 10,850,408 B2
(45) Date of Patent: Dec. 1, 2020

(54) SHAVING APPARATUS WITH DETACHABLE CUTTING UNIT

(71) Applicant: KONINKLIJKE PHILIPS N.V., Eindhoven (NL)

(72) Inventor: Harm Anton Richard Peters, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/308,961

(22) PCT Filed: Jun. 12, 2017

(86) PCT No.: PCT/EP2017/064232

§ 371 (c)(1),
(2) Date: Dec. 11, 2018

(87) PCT Pub. No.: WO2017/220360

PCT Pub. Date: Dec. 28, 2017

(65) Prior Publication Data

US 2019/0143546 A1 May 16, 2019

(30) Foreign Application Priority Data

Jun. 21, 2016 (EP) ..... 16175402

(51) Int. Cl.
*B26B 19/14* (2006.01)
*B26B 19/38* (2006.01)

(52) U.S. Cl.
CPC ..... *B26B 19/141* (2013.01); *B26B 19/145* (2013.01); *B26B 19/3853* (2013.01)

(58) Field of Classification Search
CPC ..... B26B 19/02; B26B 19/046; B26B 19/28; B26B 19/06; B26B 19/14; B26B 19/145;
(Continued)

(56) References Cited

U.S. PATENT DOCUMENTS 3,213,719 A * 10/1965 Kloack ..... B25B 15/004 81/436
3,890,705 A * 6/1975 Tietjens ..... B26B 19/14 30/43.6

(Continued)

FOREIGN PATENT DOCUMENTS

| | | | |
|---|---|---|---|
| EP | 2345516 | A1 | 7/2011 |
| GB | 1241140 | A | 7/1971 |
| WO | 2015158681 | A1 | 10/2015 |

*Primary Examiner* — Stephen Choi

(57) ABSTRACT

A shaving apparatus has at least one cutting unit detachably coupled to a drive mechanism via a coupling having first and second coupling members. The second coupling member has a coupling cavity. A coupling head of the first coupling member is in a form-locking engagement in the coupling cavity to transfer a driving force, and is detachable from the coupling cavity by movement in an axial direction parallel to an axis of rotation of the cutting unit. The second coupling member has a plurality of recesses, each recess extending in a radial direction from the coupling cavity and being delimited by two radially extending side wall sections. Each of the two radially extending side wall sections forms an edge with a bottom surface of the second coupling member, and the edges of each recess converge in a radially outward direction in relation to the axis of rotation.

20 Claims, 5 Drawing Sheets

(58) Field of Classification Search
CPC ... B26B 19/386; B26B 19/063; B26B 19/141; B26B 19/3853
See application file for complete search history.

(56) References Cited

U.S. PATENT DOCUMENTS

| | | | | |
|---|---|---|---|---|
| 5,678,967 | A | 10/1997 | Savoie | |
| 6,382,680 | B1 | 5/2002 | Horimoto | |
| 6,722,038 | B2 | 4/2004 | Visman | |
| 7,698,819 | B2 * | 4/2010 | De Wit | B26B 19/3846 30/43.5 |
| 2014/0150191 | A1 | 6/2014 | De Wit | |

* cited by examiner

SHAVING APPARATUS WITH DETACHABLE CUTTING UNIT

This application is the U.S. National Phase application under 35 U.S.C. § 371 of International Application No. PCT/EP2017/064232, filed on Jun. 12, 2017, which claims the benefit of European Application No. 16175402.3 filed on Jun. 21, 2016. These applications are hereby incorporated by reference herein.

FIELD OF THE INVENTION

The invention relates to a shaving apparatus with at least one cutting unit detachably coupled to a drive mechanism via a coupling. The invention further relates to an internal cutting member for a shaving apparatus, the internal cutting member comprising a coupling member of such a coupling. The invention further relates to a cutting unit for a shaving apparatus, comprising an external cutting member and an internal cutting member according to the invention.

BACKGROUND OF THE INVENTION

EP 1 417 079 B1 describes a rotary shaving apparatus and a coupling for an internal cutting member thereof. The shaving apparatus disclosed in this document comprises three cutting units arranged side by side in a triangular relationship to each other to form a cutting head of a shaving apparatus. It is to be understood that, whereas such a triangular arrangement of three cutting units is generally preferred, other arrangements of such cutting units to form a cutting head of a shaving apparatus could be employed, e.g. arrangements with a single cutting unit, two cutting units, or arrangements with more than three cutting units.

Each cutting unit comprises an external cutting member and an internal cutting member. The external cutting member comprises a plurality of openings, for example in the form of slots, through which hairs can penetrate the cutting unit. The internal cutting member comprises a single shear blade or a plurality of shear blades, which can be driven into rotation in relation to the external cutting member about an axis of rotation. The shear blades of the internal cutting member co-operate with the openings in the external cutting member and thereby apply a shear force onto each hair present in the openings resulting in cutting of these hairs.

Generally, it is preferred that the cutting units are pivotable relative to a stationary part of the shaving head carrying the cutting units to allow the cutting units to follow the local contours of the skin and to thus improve the contact of the external cutting member and the skin of the user. In order to allow pivoting movements of the cutting units, the drive train of the shaving apparatus is specifically adapted. One aspect of this specific adaptation is a coupling, which is driven into rotation by a drive mechanism of the shaving apparatus, like e.g. the drive shaft of an electric motor. Said coupling comprises a coupling head transferring a torque to the internal cutting member via a coupling cavity arranged in a coupling member of the internal cutting member. The coupling head is engaged in said coupling cavity by a form-locking engagement to transfer a driving torque from said coupling head to said coupling member.

To allow pivoting movements of the cutting unit in relation to the drive mechanism, said form-locking engagement between the coupling head and the coupling cavity is specifically designed, with the coupling head being formed such that it is substantially triangular in cross-section with curved, convex driving surfaces, wherein the curvature of said convex driving surfaces has a radius of curvature in a cross-sectional plane transverse to the axis of rotation and a radius of curvature in a longitudinal section along said axis of rotation. This geometry of the coupling head enables pivoting movements of the cutting unit, and the transfer of the driving torque is achieved via the convex driving surfaces, i.e. not via the edges of the triangular coupling head. This results in a rather silent transfer of the driving torque, silent rotation of the internal cutting member, and low wear of the coupling.

A relevant function of such cutting units is the possibility to clean the shaving apparatus from time to time to remove cut-off hairs and to ensure a proper functioning. Such maintenance and cleaning actions are improved by the fact that the cutting unit or the whole shaving head carrying the cutting units is detachable from the handle or main body of the shaving apparatus incorporating the drive mechanism. The shaving apparatus disclosed in EP 1 417 079 B1 allows decoupling of the drive train from the cutting unit by decoupling the coupling head of the drive train from the coupling cavity of the coupling member of the internal cutting member. Vice versa, if the shaving apparatus is assembled again after a cleaning action, the coupling head is to be inserted into said cavity again. It is an object of the invention to facilitate this maintenance and cleaning of a shaving apparatus.

SUMMARY OF THE INVENTION

According to the invention, an internal cutting member for a shaving apparatus is provided, the internal cutting member having a coupling member comprising a coupling cavity adapted to detachably receive a coupling head of the shaving apparatus inside said coupling cavity, wherein said coupling cavity comprises a plurality of driven surfaces arranged to receive a driving force to induce a driving torque about an axis of rotation, and wherein said coupling cavity has a cavity opening for receiving said coupling head by a movement of said coupling head in relation to said coupling cavity in an axial direction parallel to the axis of rotation, and wherein said coupling member further comprises a plurality of recesses, each recess extending in a radial direction relative to the axis of rotation from said coupling cavity and being delimited by two side wall sections which each extend with a radial direction component with respect to the axis of rotation, wherein each of said two side wall sections of each of said recesses forms an edge with a bottom surface of said coupling member, and wherein said edges of each recess converge in a radially outward direction in relation to said axis of rotation.

The coupling member of the internal cutting member according to the invention provides for a better functionality regarding the mounting of the internal cutting member in a shaving apparatus in the course of a maintenance or cleaning action. The internal cutting member according to the invention can also be used as a replacement component for use in existing shaving apparatuses as well as a component used to incorporate the invention in existing designs of shaving apparatuses during the manufacturing stage.

According to the invention, the coupling cavity comprises a plurality of driven surfaces for receipt of said driving force from the coupling head, and a plurality of radially extending recesses. Said recesses fulfill a function with regard to the maintenance and cleaning of the shaving apparatus. Each recess comprises two radially extending sidewall sections.

It is to be understood that, according to the invention, a radial direction or extension does not define an exact geometrical radial direction with respect to a center point of a circle or sphere or with respect to an axis. Instead, a radial direction according to the invention is defined as a direction having a main radial direction component, but which may in addition have a minor tangential or axial direction component with respect to the center point or axis. The bottom edges of the two sidewall sections of each recess converge in a radially outward direction in relation to the axis of rotation of the coupling member. This convergence of the edges of the recesses results in the recesses being broader at their radial inner sides than at their radial outer sides at the bottom of the coupling member. The recesses extend from the central coupling cavity, and it is to be understood that each recess has a smaller width than said coupling cavity, such that the coupling head is too big to fully enter into the recesses.

The bottom surface of the coupling member is to be understood to be the side surface of the coupling member facing towards the coupling head and the shaving apparatus in the assembled condition of the internal cutting member and the shaving apparatus.

The convergent design of the edges of the recesses improves the guidance of the coupling head towards the coupling cavity, in particular when the internal cutting member is mounted to the coupling head after a maintenance action or cleaning action. The improved guidance is achieved as a result of an effect which is similar to a marble rolling on two non-parallel tracks. The two non-parallel tracks are formed by the convergent edges of the recesses facing towards the coupling head. The marble is represented by the coupling head. Since the marble will roll to the wider end of the non-parallel tracks, this effect results in the coupling head being guided towards the coupling cavity, i.e. in a radially inward direction. By virtue of this, the coupling of the coupling head into the coupling cavity is improved and misalignment of the coupling head after assembling the coupling is prevented.

Preferably, the convergent design of the edges is formed by a convergent arrangement of the side walls.

In a preferred embodiment of the internal cutting member according to the invention, each of said recesses forms a through-hole in said coupling member. By designing the recesses as through-holes, namely as openings reaching through the coupling member, the escape of hairs from the cutting unit through the coupling member is enabled during operation of the shaving apparatus, when the internal cutting member is incorporated in the cutting unit of the shaving apparatus. Thus, blocking or malfunction of the cutting unit due to hairs accumulating in the cutting unit can be prevented. By virtue of this, the recesses in the coupling member fulfill a twofold function. First, the escape of hairs out of the cutting unit is made possible. Second, the insertion of the coupling head into the coupling cavity during mounting of the cutting unit to the shaving apparatus after maintenance or cleaning is improved.

In a further preferred embodiment of the internal cutting member according to the invention, at least one of the edges of each recess is chamfered. According to this embodiment, the edge formed between the bottom surface of the coupling member and at least one of the side wall sections of each recess is chamfered, i.e. a bevel comprising e.g. a 45° facet is established at the location of this edge. Such a chamfered design of the edge improves the centering of the coupling head along the edges of the recess in case the coupling head is positioned eccentrically relative to the axis of rotation in the course of mounting the coupling. Thus, the chamfered design of the edge enhances a correct alignment of the coupling head, by means of a partial engagement in one of the recesses and a subsequent sliding along said chamfered edge and the recess into a central position where the coupling head can enter into the cavity.

It is generally to be understood that only one edge of each recess at said bottom surface may be chamfered. Alternatively, both edges of each recess at the bottom surface may be chamfered. A chamfered edge may extend along the full radial extent of the recess, but in certain embodiments only a section of an edge between a side wall section of the recess and the bottom surface may be chamfered, in particular a radially inward section of the edge.

In a further preferred embodiment of the internal cutting member according to the invention, a region of one of said two side wall sections of each recess constitutes one of said driven surface. In this embodiment, a side wall section of each recess constitutes a driven surface, and thus said region of the side wall section reaches into the coupling cavity. This embodiment may be formed such that the driven surfaces of the coupling cavity are flush or continuous with a side wall section of a respective one of the recesses, such that the coupling cavity is formed by radially inward intersections of the recesses, e.g. in a star-like configuration, wherein two, three, four or more than four recesses extend radially outward from a central common portion forming the coupling cavity. In this embodiment, the guidance of the coupling head, when being directed radially inward by the diverging geometry of the edges of the recesses from the outside to the central portion, is optimized in that the coupling head may directly enter into the coupling cavity after being guided along one of the recesses.

In a further preferred embodiment of the internal cutting member according to the invention, for each recess only the edge formed by the bottom surface and the side wall section opposed to the driven surface is chamfered. In this embodiment, only one chamfered edge is provided at each recess, and this single chamfered edge is provided at the side wall section opposed to the driven surface, i.e. at the non-driven side wall section. As a result, the surface area of the driven surface is not reduced by a chamfered edge, and thus an effective transfer of the driving force can be realized via the driven surface.

In a further preferred embodiment of the internal cutting member according to the invention, said chamfered edge extends at least partially into an adjacent recess, such that at least a part of the driven surface of said adjacent recess forms a chamfered edge with the bottom surface. In this embodiment, the chamfered edge does not only extend along the non-driven side wall section of the associated recess, but also along the edge between the bottom surface and the driven surface of the adjacent recess. Such an elongated chamfered edge further improves the centring effect on the coupling head in the course of mounting of the coupling, in that the coupling head is guided to the coupling cavity by said chamfered edges even if it is positioned on the bottom surface adjacent to a driven side wall section.

Generally, it is to be understood that the design of said chamfered edge may be improved to optimize the centring effect on the coupling head, while at the same time enabling a safe and wear resistant transfer of the driving force from said drive surfaces to said driven surfaces. For this purpose, an inclination angle of the chamfered edge may change along the longitudinal extent of the edge. In particular, the inclination angle, which is defined as the angle between the chamfered edge and the bottom surface, may decrease in a radially inward direction relative to the axis of rotation. In addition or alternatively, a width of the chamfered edge may change along the longitudinal extent of the edge. In particular, the width of the chamfered edge may increase in a radially inward direction relative to the axis of rotation.

In an embodiment of the internal cutting member according to the invention, said bottom surface of the coupling member is sloped, seen in a radially inward direction relative to the axis of rotation, to form a funnel-like geometry for guiding the coupling head radially inward with respect to the axis of rotation when applying an axial mounting force. Such an axial mounting force is understood to either effect the guidance of the coupling head into the coupling cavity in the course of attaching the internal cutting member to the coupling head, or to effect such guidance after attaching the internal cutting member to the coupling head. In the latter case, the coupling head may first find a first stable position, eccentric relative to the axis of rotation, under the influence of static friction provided by the bottom surface. But, upon use of the shaving apparatus when the coupling head is set into rotation, the coupling head will slide into the coupling cavity under dynamic friction provided by the bottom surface, wherein the inclination of the bottom surface effects a secure and rapid radially inward sliding movement of the coupling head. The inclination of the bottom surface in a radially inward direction thus provides an inner conical surface formed by the bottom surface, and the guidance of the coupling head towards the coupling cavity is further improved by this inclination. Generally, it is to be understood that such inclination may effectively facilitate mounting of the coupling head and its guidance into the coupling cavity. In particular, if the inclination of the bottom surface is rather steep, a very effective guidance of the coupling head will be achieved. However, one drawback of such a relatively steep inclination of the bottom surface is a significant demand for space in the axial direction relative to the axis of rotation. This will increase the total axial length of the drive train of the shaving apparatus and, in addition, will not allow modifying an existing design of a shaving apparatus without significant other geometrical changes. Thus, according to the invention, the limited effect of guidance of the coupling head by a relatively small inclination of the bottom surface of the coupling member is strongly increased by the effect of guidance of the coupling head by the convergent design of the recesses and the edges thereof. This convergent design results in a significantly improved guidance of the coupling head towards the centrally arranged coupling cavity. At the same time, the axial length of the coupling member can be kept constant or even reduced.

A further aspect of the invention is a cutting unit for a shaving apparatus, comprising an external cutting member and an internal cutting member according to the invention, wherein the internal cutting member can be driven into rotation with respect to the external cutting member about the axis of rotation.

A further aspect of the invention is a shaving apparatus provided with at least one cutting unit according to the invention, the shaving apparatus comprising a drive mechanism for driving the internal cutting member into rotation, and a coupling for transferring a driving force from the drive mechanism to the internal cutting member, said coupling comprising a first coupling member having a coupling head, the coupling member of the internal cutting member of the cutting unit forming a second coupling member of the coupling, wherein said coupling head and the coupling cavity of the second coupling member are in a form-locking engagement to transfer said driving force inducing a driving torque about the axis of rotation, wherein said coupling head is detachably inserted into said coupling cavity and is detachable from said coupling cavity by a movement of said coupling head in relation to said coupling cavity in an axial direction parallel to the axis of rotation.

The second coupling member of the shaving apparatus according to the invention corresponds to the coupling member incorporated in the internal cutting member according to the invention as described hereinbefore, and may in particular be improved according to the characteristics of said coupling member as described hereinbefore. Thereby, the shaving apparatus according to the invention comprises a coupling, which allows smooth and safe demounting and mounting of the cutting unit from and to the drive mechanism. The coupling comprises a first and a second coupling member, wherein the first coupling member has a coupling head and the second coupling member has a coupling cavity. The coupling head is arranged in the coupling cavity in operation of the shaving apparatus, and a driving torque and rotation are transferred from said coupling head to said coupling cavity by a form-locking engagement of the coupling head in the coupling cavity. It is to be understood that the coupling head and the coupling cavity may preferably transfer said driving torque and rotation via a triangular cross-sectional design of the coupling head interacting with a corresponding number of three driven surfaces of the cavity in a triangular arrangement. However, other form-locking engagements and designs of the coupling head and the coupling cavity are understood to be comprised by the invention as defined in the claims. As discussed hereinbefore, a specific aspect of the invention is the ability to improve the guidance of the coupling head towards the coupling cavity along the bottom surface of the coupling member of the internal cutting member, i.e. the second coupling member of the shaving apparatus, without the need to change the axial height of the coupling member. This particular aspect allows using the coupling member of the internal cutting member to replace a coupling member of an internal cutting member in existing shaving apparatuses to thus improve the functionality of these apparatuses with regard to cleaning and maintenance without the need to adapt other parts of the cutting unit or shaving apparatus.

In a first preferred embodiment of the shaving apparatus according to the invention, said coupling head comprises a plurality of drive surfaces for transmitting said driving force to said driven surfaces.

Generally, it is to be understood that the form-locking engagement of the coupling head and the coupling cavity could be achieved by various different geometries. It is preferred to have a plurality of drive surfaces on the coupling head engaging a corresponding plurality of driven surfaces in the coupling cavity to realize the form-locking engagement and the transfer of the driving torque. Such a design allows a smooth and safe transfer of the driving torque and a smooth rotation of the coupling. Further, such a plurality of drive surfaces and driven surfaces can be designed in a rotational symmetry to allow insertion of the coupling head into the coupling cavity in a plurality of angular positions in order to further facilitate the mounting and demounting of the coupling for maintenance and cleaning. In general, a drive surface and a driven surface shall be understood to be a surface which lies in a non-tangential plane with respect to the axis of rotation and thus allows the transfer of a driving force inducing a driving torque.

In a further preferred embodiment of the shaving apparatus according to the invention, either said drive surfaces or said driven surfaces are curved to allow pivotal movement of the coupling head in said coupling cavity such that an axis of rotation associated with the first coupling member is in angular displacement relative to said axis of rotation of the internal coupling member. As explained in the introductory part of this description, it is particularly preferred that the cutting unit of the shaving apparatus is pivotable to follow the local contours of the skin. Such pivotal movement will require the drive train to be able to transfer the torque and rotation to the cutting unit even when the cutting unit and the drive train are not aligned along a straight axial direction, but are angled relative to each other. This may be achieved by a curved geometry of either the drive surfaces or the driven surfaces. Such a curved geometry will establish either a point or line contact or a spherical contact surface between the drive surfaces and the driven surface. This specific geometry will avoid a rigid coupling and will allow mutual angular displacement or mutual pivotal movement of the coupling members of the coupling in order to follow angular displacements of the cutting unit in relation to the drive mechanism.

In a further preferred embodiment of a shaving apparatus according to the invention, either said drive surfaces or said driven surfaces are curved in a sectional plane oriented perpendicularly to the axis of rotation. Alternatively or in addition, either said drive surfaces or said driven surfaces are curved in a sectional plane oriented parallel to the axis of rotation. Such specific curvatures either in a sectional plane oriented perpendicularly to the axis of rotation, i.e. in a cross-section of the coupling head or coupling cavity, or in a sectional plane oriented parallel to the axis of rotation, i.e. in a longitudinal section of the coupling head or coupling cavity, or in both sectional planes, will provide for a smooth mutual angular displacement of the coupling members of the coupling and will avoid wear of the driving and driven surfaces at the same time.

It is to be understood that the two preferred embodiments explained before may be further improved in that said curved surface is convex. Generally, the geometry of the coupling head may correspond to the geometry of the coupling head disclosed in EP 1 417 079 B1, wherein the drive surfaces of the coupling head in the present invention correspond to the curved drive surfaces of EP 1 417 079 B1 and wherein curved connecting surfaces between said drive surfaces are present. Further, the driven surfaces of the coupling cavity in the present invention may correspond to the driven surfaces provided in the cavity of the coupling member according to EP 1 417 079 B1. It is further to be understood that the radius of curvature of the drive surfaces and the bearing surface at the upper end of the coupling head in the current invention may correspond to the geometries disclosed in EP 1 417 079 B1, and reference is made to the disclosure in paragraphs [0001], [0002], and [0007]-[0010] of EP 1 417 079 B1 as well as to the details shown in FIGS. 1-7 of EP 1 417 079 B1. In particular, the second coupling member may comprise three recesses arranged in a 120° orientation relative to each other about the axis of rotation. The arrangement of such three recesses will provide safe guidance of the coupling head towards the coupling cavity and into the coupling cavity along the edges of the recesses in any position of the coupling head when touching the bottom surface of the second coupling member in the course of mounting the detachable coupling.

In a further embodiment of a shaving apparatus according to the invention, an upper face of said coupling head has a domed geometry. The upper face of the coupling head may contact the bottom surface or the edges of the recesses of the second coupling member. Directing of the coupling head towards the centrally arranged coupling cavity of the second coupling member will be effected by contact of said upper face of the coupling head with said bottom surface and/or the edges of the recesses. Thus, the geometry of the upper face of the coupling head has an influence on the guidance and sliding of the coupling head towards the coupling cavity. It has been generally observed that a coupling head having an upper face with a domed geometry, i.e. an axially outward convexity of the upper face, shows improved guidance and sliding towards the centrally arranged coupling cavity. In particular, said domed geometry of the upper face may be embodied as a conical shape, a truncated cone shape, or a curved shape like e.g. a convex shape or a spherical shape. Further, the upper face of the coupling head may be formed from multiple sections composed of different geometries as listed hereinbefore. It is particularly preferred that the upper face of the coupling head serves as a bearing surface, a corresponding co-operating bearing surface being provided in the bottom of the coupling cavity. In this particular embodiment, the inner geometry of the second coupling member formed by the recesses and the coupling cavity shall not have the form of a single through-hole. Rather, multiple through-holes may be formed by the recesses, allowing passing through of hairs through the second coupling member. In this embodiment, the access of hairs into the coupling cavity, onto the axial bearing surfaces formed by the bottom of the coupling cavity and the upper face of the coupling head, and onto the drive surfaces and driven surfaces is prevented or reduced in that the cavity is closed at its bottom to form an axial bearing counterpart for the coupling head.

Preferred embodiments of the invention will be explained in detail with reference to the drawings.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF THE EMBODIMENTS

Figure 1:
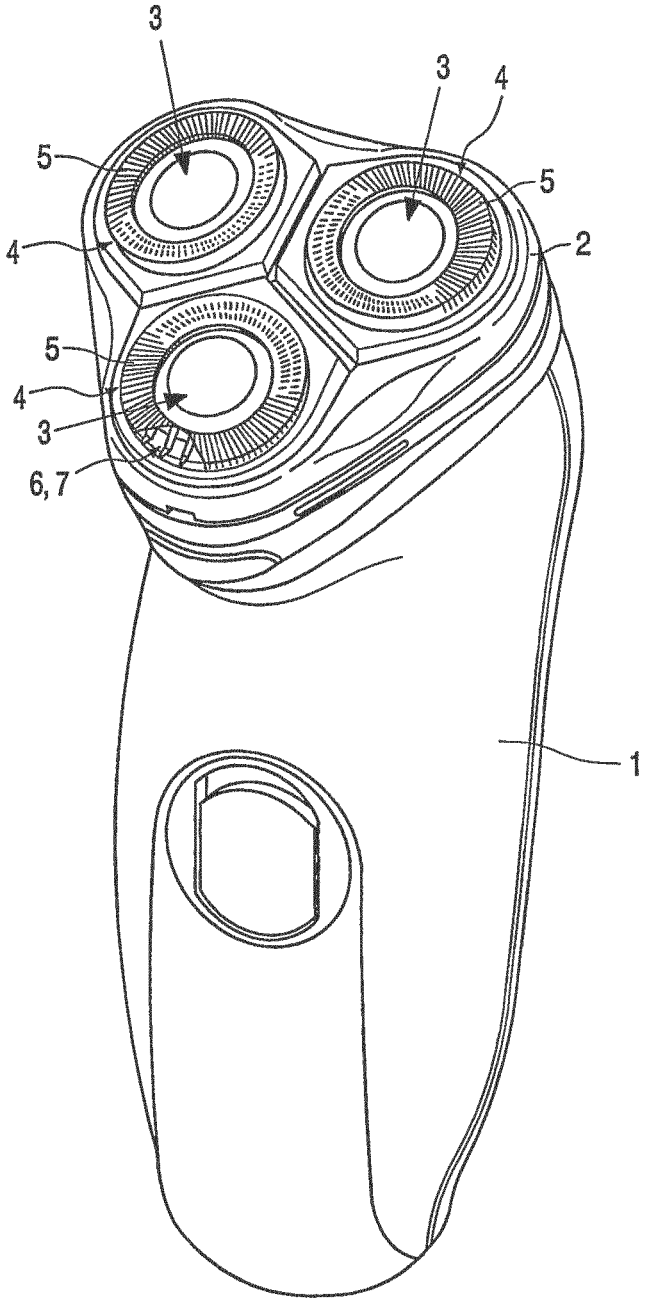
FIG. 1 shows a shaving apparatus according to the invention having three cutting units.

FIG. 1 shows a rotary shaving apparatus according to the invention, comprising a housing 1 and a shaving-head holder 2 which is detachable from the housing 1 and/or hinged to the housing 1. Three rotary cutting units 3, also denoted as shaving heads, are arranged in the shaving-head holder 2, each having an external cutting member 4 with hair trap openings 5 and an internal cutting member 6 with cutter elements 7, which can be driven into rotation with respect to the external cutting member 4. The internal cutting member 6 is driven by a motor 8 accommodated in the housing 1.

Figure 2:
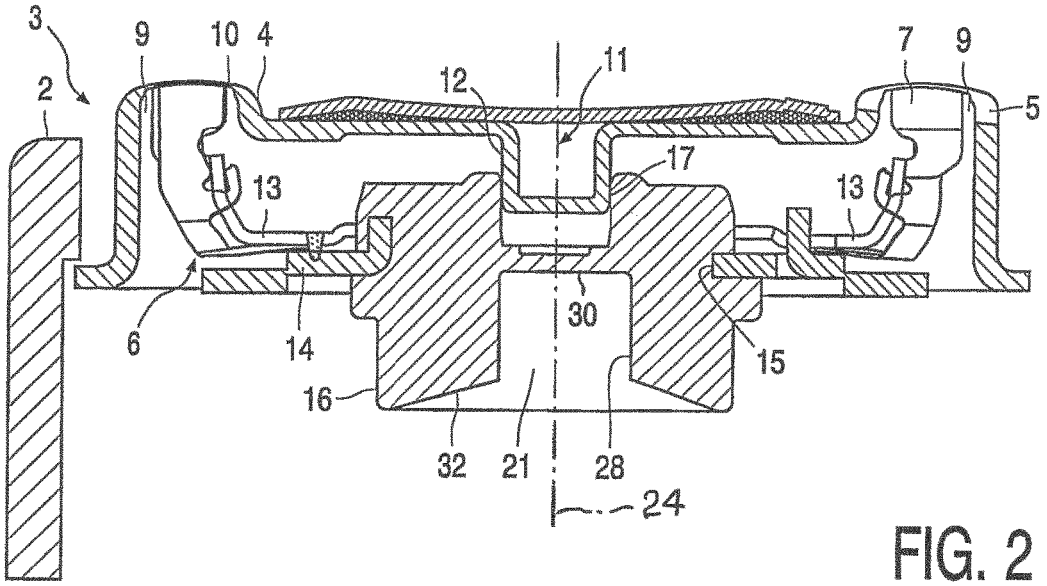
FIG. 2 is a cross-sectional view of a cutting unit of the shaving apparatus shown in FIG. 1.

FIG. 2 shows one of the cutting units 3 on an enlarged scale. The external cutting member 4, which has the shape of a circular cap, is provided with an internal circular groove 9, also denoted as shaving track. A large number of lamellae 10, which are substantially radially directed with respect to the center of the cap, are present in the bottom wall and in the vertical side walls of the groove 9. The hair trap openings 5 extend between these lamellae 10. The external cutting member 4 is provided with a central bearing shaft, which extends in an axial direction parallel to a center line 11 of the external cutting member 4. The bearing shaft is formed by a central projection 12 of the external cutting member 4. The internal cutting member 6 comprises a metal plate-shaped carrier 13, with the cutter elements 7 integrally provided at the circumference of the carrier 13. The end portions of the cutter elements 7 have cutting edges, which cooperate with mating edges of the lamellae 10 for cutting off hairs which project through the hair trap openings 5 into the shaving track. The carrier 13 is fastened to an annular support 14 having a central opening 15. A second coupling member 16 is fastened in the central opening 15 of the annular support 14. The second coupling member 16 is provided with a bearing bush 17 in which the central projection 12 (bearing shaft) of the external cutting member 4 is journaled.

The internal cutting member 6 is driven by a first coupling member 18, which comprises a coupling head 19 and a coupling body 20. For this purpose, the second coupling member 16 has a coupling cavity 21 in which the coupling head 19 can be accommodated. The coupling body 20 is fastened to a drive shaft 22 of the motor 8, with resilience in the axial direction. For this purpose, a spring 23 is mounted between the coupling body 20 and the drive shaft 22. It is noted that, between the motor 8 and the coupling body 20, gear wheels may be arranged to adapt the rotational speed of the coupling head 19 and to transmit the rotation of the motor 8 also to the other cutting units 3.

Figure 3:
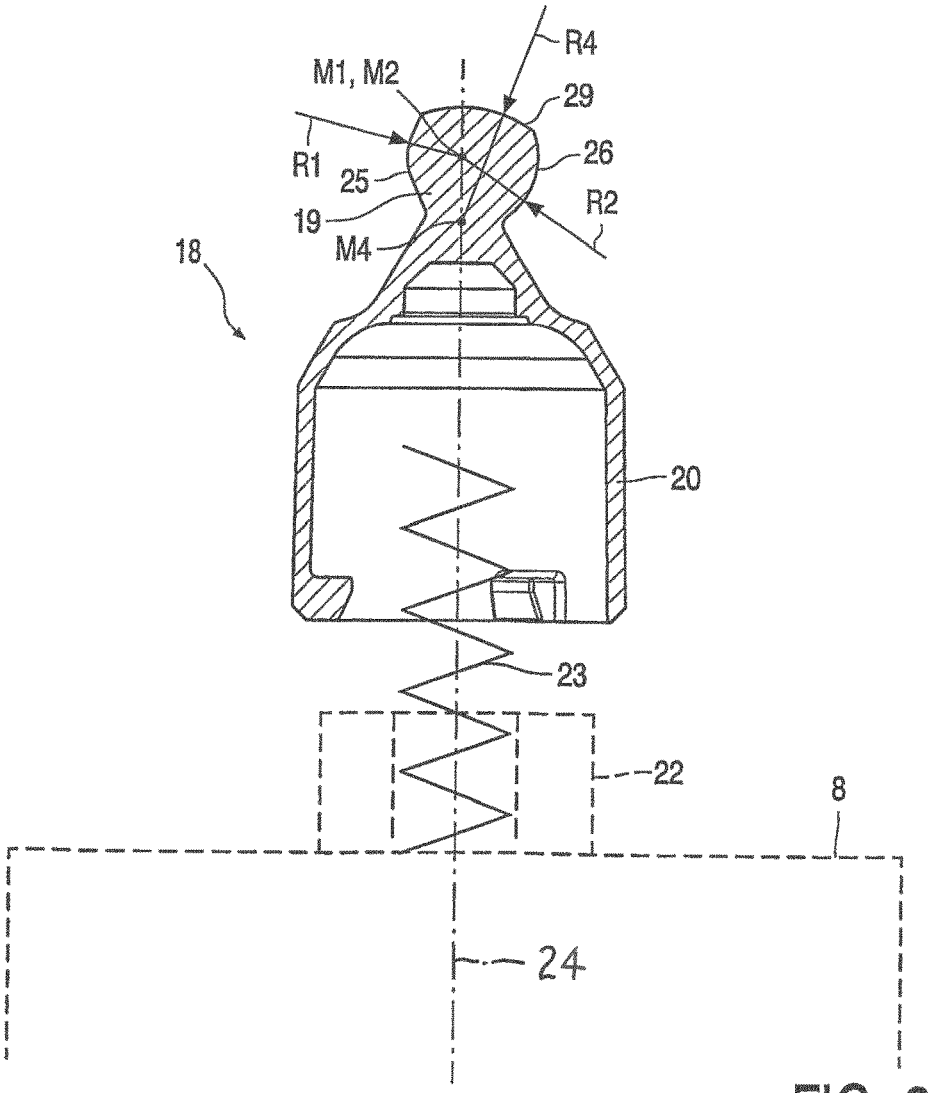
FIG. 3 is a cross-sectional view of a first coupling member of the shaving apparatus shown in FIG. 1, taken on the line III-III in FIG. 6.
Figure 4:
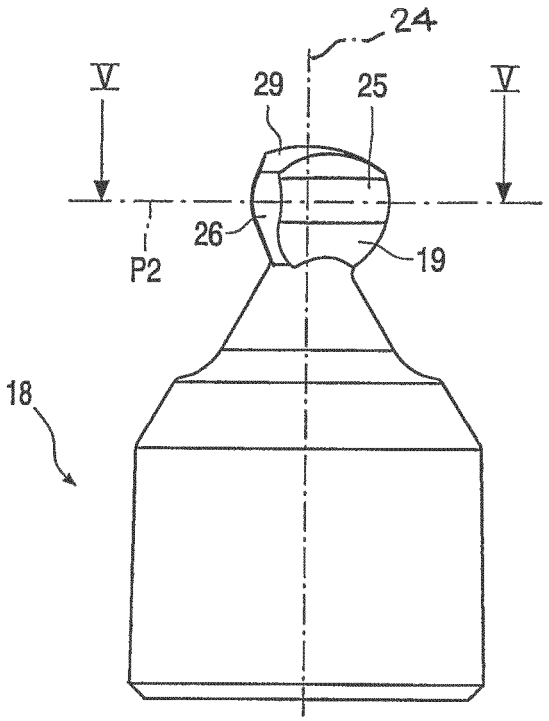
FIG. 4 is a side elevation of the first coupling member shown in FIG. 3.
Figure 5:
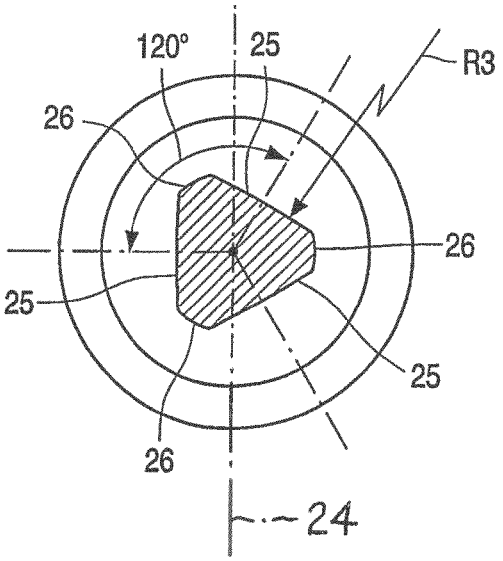
FIG. 5 is a cross-sectional view of the first coupling member, taken on the line V-V in FIG. 4.
Figure 6:
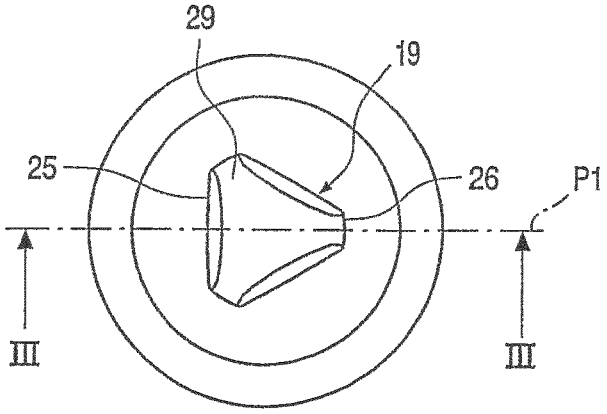
FIG. 6 is a plan view of the first coupling member shown in FIGS. 3 and 4.
Figure 7:
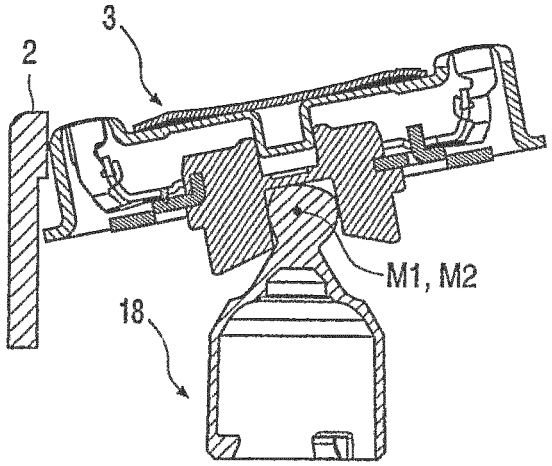
FIG. 7 shows the cutting unit of FIG. 2 in a tilted position.

The first coupling member 18 has an axis of rotation 24. As shown in FIGS. 4 to 6, the coupling head 19, seen in the direction of the axis of rotation 24, has a substantially triangular shape, which is rotationally symmetrical through 120°. The coupling head 19 has three curved drive surfaces 25 between which curved connecting surfaces 26 are present. FIG. 3 shows the first coupling member 18 in a cross-section in a plane P1 (i.e. the cross-section III-III in FIG. 6), which comprises the axis of rotation 24 and which is transverse to one of the drive surfaces 25. This plane P1 is also perpendicular to one of the connecting surfaces 26 as a result of the rotational symmetry through 120°. In the cross-sectional view of FIG. 3, the drive surface 25 has a curvature with a first radius of curvature R1 whose center M1 lies on the axis of rotation 24. In the same cross-sectional view, the connecting surface 26 has a curvature with a second radius of curvature R2 whose center M2 also lies on the axis of rotation 24 and coincides with the center M1 of the curved drive surface 25. The radius of curvature R2 is larger than the radius of curvature R1 here. The other drive surfaces 25 and connecting surfaces 26 have similar geometries, seen in corresponding cross-sectional views. The centers M1 and M2 may be regarded as the drive center of the coupling head 9. During operation of the shaving apparatus, the cutting unit 3 is capable of pivoting relative to the coupling head 19, wherein M1 and M2 constitute the center of the pivoting movement of the cutting unit. This is shown in FIG. 7. Furthermore, each drive surface 25 of the coupling head 19 has a slight curvature with a relatively large radius of curvature R3 seen in a plane P2 (i.e. the cross-section V-V shown in FIG. 5) perpendicular to the axis of rotation 24, such that R3 is much larger than R1 or R2. The reason for this will be explained below.

Figure 8:
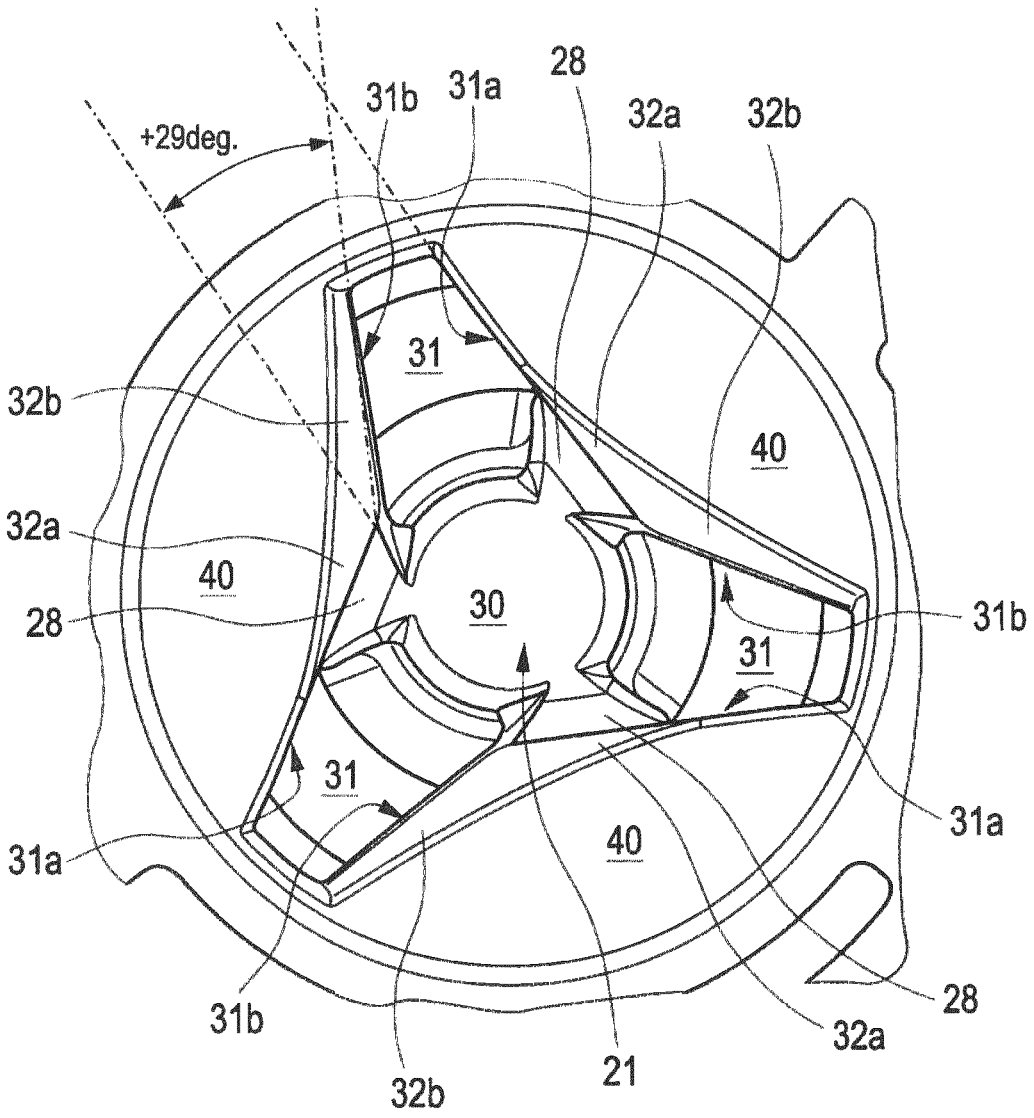
FIG. 8 is a plan bottom view of a second coupling member of the cutting unit shown in FIG. 2.

FIG. 8 is a bottom view of a preferred embodiment of the second coupling member 16 of the internal cutting member 6 according to the invention. The coupling cavity 21 has a triangular shape, which is rotationally symmetrical through 120°, as is the coupling head 19. It is apparent that the coupling head 19 makes contact with the walls of the coupling cavity 21 at three locations. In particular, the three curved drive surfaces 25 of the coupling head 19 bear on three driven surfaces 28 of the second coupling member 16 in three points of contact. The large radius of curvature R3 of the drive surfaces 25 of the coupling head 19 ensures that the points of contact of the cooperating drive surfaces 25 and driven surfaces 28 will always lie on the drive surfaces 25, i.e. not on the edges between the drive surfaces 25 and the connecting surfaces 26.

As shown in FIG. 8, the coupling cavity 21 is located in the center of the second coupling member 16. The coupling cavity 21 is connected with three recesses 31 arranged in a star-like geometry, wherein each recess 31 extends in a radial direction with respect to the axis of rotation 24 from the coupling cavity 21. Each recess 31 comprises side wall sections 31*a*, 31*b*, wherein side wall section 31*a* of each recess is flush with a respective one of the driven surfaces 28 of the coupling cavity 21 at the inner portion of the coupling cavity 21. The side wall sections 31*a*, 31*b* are not parallel to each other, but rather converge seen in a radially outward direction in relation to the axis of rotation 24. As a result, edges 32*a*, 32*b* formed between a bottom surface 40 of the second coupling member 16 and the side wall sections 31*a*, 31*b* also converge in said radially outward direction relative to the axis of rotation 24, and the edges 32*a*, 32*b* thus form a divergent guidance for the coupling head 19 in a direction towards the coupling cavity 21. Said divergent orientation of the edges 32*a*, 32*b* in a direction towards the coupling cavity 21 acts as a non-parallel track for the coupling head 19 in case the coupling head 19 is not aligned relative to the coupling cavity 21 when the coupling head 19 is to be mounted into the coupling cavity 21. In such a case, during connection of the coupling head 19 into the coupling cavity 21, the coupling head 19 will be moved towards the coupling cavity 21 along the divergent edges 32*a*, 32*b* acting as non-parallel tracks. It shall be understood that the effect of the coupling head 19 being guided in a radially inward direction towards the coupling cavity 21 is similar to the effect of a marble rolling over two non-parallel tracks, wherein the marble will roll in a direction in which the tracks diverge.

The non-driven side wall section 31*b* of each recess 31 forms an edge 32*b* with the bottom surface 40 of the second coupling member 16. The edge 32*b* is chamfered, resulting in a beveled surface or chamfer on the edge 32*b*. The chamfered edge 32*b* further improves guidance of the coupling head 19 towards the coupling cavity 21. As can be seen in FIG. 8, the non-driven side wall sections 31*b* each have such a chamfered edge 32*b* over their complete longitudinal extent along the bottom surface 40. In each recess 31, the edge between the opposed side wall section 31*a* and the bottom surface 40 is not chamfered in the way of the opposite edge 32*b*, but is rather rectangular with a slight rounding. Further, the driven surfaces 28 each have a chamfered edge 32*a* at the bottom surface 40. The chamfered edges 32*a* are each flush with one of the respective chamfered edges 32*b*. As a result, the chamfered edges 32*b* provided along the non-driven side wall sections 31*b* extend into the chamfered edges 32*a* provided along the driven surfaces 28, but do not extend along the side wall sections 31*a* which are flush with the driven surface sections 28, as shown in FIG. 8. However, it should be understood that in other embodiments both edges 32*a*, 32*b* of each recess 31 may be chamfered along their whole longitudinal extent.

In the embodiment shown in FIG. 8, each side wall section 31*a*, 31*b* encloses an angle of 14.5° with a radial line running through the center of the second coupling member 16, resulting in an angle of convergence of each pair of side wall sections 31*a*, 31*b* of 29°. It should be understood that the angle of convergence of the side wall sections 31*a*, 31*b* and of the edges 32*a*, 32*b* is preferably in a range of 10-40°, more preferably in a range having a lower limit of 15° or 20° or even 25° and an upper limit of 35°, 30° or even 25°.

FIG. 8 shows the recesses 31 in a mutual orientation which is rotationally symmetric about the middle axis of the second coupling member 16 (or about the axis of rotation 24), and each recess 31 is mirror-symmetric with respect to a symmetry line coinciding with a radius line of the second coupling member 16. It is to be understood that, whereas rotational symmetry of the recesses 31 about the middle axis is preferred, each single recess 31 need not have a mirror-symmetrical design with respect to a radius line, but may be non-symmetrical in other embodiments.

Generally, the converging edges 32*a*, 32*b* may be straight, but other edge designs, like curved edges or edges with multiple straight edge sections in an angular arrangement with respect to each other, may be preferable in other embodiments. It is to be understood that, accordingly, the side wall section, which forms the edge with the bottom surface, may be planar, curved or may comprise a plurality of planar surface sections in a mutually angular arrangement.

The coupling cavity 21 is closed at its bottom, i.e. at the upper end of the second coupling member 16 in the center region, by a bearing surface 30. The recesses 31 are formed as through-holes through the second coupling member 16 and thus each allow for the escape of hairs from the upper to the lower side of the second coupling member 16 during operation.

The coupling head 19 has an upper surface, which is designed as an axial spherical bearing surface 29 (see FIGS. 3 and 4). The spherical bearing surface 29 co-operates with the bearing surface 30 of the second coupling member 16 (see FIG. 2) situated in the center of the coupling cavity 21. The spherical bearing surface 29 has a curvature with a radius of curvature R4 whose center M4 lies on the axis of rotation 24 (see FIG. 3). The radius of curvature R4 is larger than the radii of curvature R1 and R2, viewed in the direction of the axis of rotation 24. The center M4 thus lies below the drive center M1, M2, which results in a greater stability.

The through-holes in the second coupling member 16 provided by the recesses 31 prevent contamination, especially by cut-off hairs and skin grease, from entering the coupling cavity 21. Such contamination could hamper the insertion of the coupling head 19 into the coupling cavity 21. Cut-off hairs and skin grease are sucked through the recesses 31 during operation of the shaving apparatus and will not enter between the first and second coupling members 18, 16. The second coupling member 16 is further provided with sloping inlet surfaces 32 (see also FIG. 2) which facilitate the introduction of the coupling head 19 into the coupling cavity 21 when the holder 2 with the cutting unit 3 is placed on the housing 1.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

Any reference signs in the claims should not be construed as limiting the scope.

The invention claimed is:

1. An internal cutting member for a shaving apparatus, the internal cutting member comprising a coupling member having a coupling cavity adapted to detachably receive a coupling head of the shaving apparatus inside said coupling cavity, wherein said coupling cavity has a plurality of driven surfaces, arranged to receive a driving force to induce a driving torque about an axis of rotation, wherein said coupling cavity has a cavity opening for receiving said coupling head by a movement of said coupling head in relation to said coupling cavity in an axial direction parallel to the axis of rotation, wherein said coupling member has recesses, each recess of said recesses extending in a radial direction relative to the axis of rotation from said coupling cavity and being delimited by two side wall sections which each extends with a radial direction component with respect to the axis of rotation, wherein each of said two side wall sections of the each recess of said recesses forms an edge with a bottom surface of said coupling member, and wherein said edges of the each recess converge on each other in a radially outward direction in relation to said axis of rotation.

2. The internal cutting member according to claim 1, wherein a region of one of said two side wall sections of the each recess constitutes one of said plurality of driven surfaces.

3. The internal cutting member according to claim 1, wherein each of said recesses forms a through-hole in said coupling member.

4. The internal cutting member according to claim 1, wherein at least one of the edges of the each recess is chamfered to form at least one chamfered edge.

5. The internal cutting member according to claim 1, wherein for the each recess only a first edge of the edges formed by the bottom surface and a first side wall section of the two side wall sections opposed to one of the plurality of driven surfaces is chamfered.

6. The internal cutting member according to claim 4, wherein a chamfering of said at least one chamfered edge increases in a radially inward direction toward the axis of rotation.

7. The internal cutting member according to claim 4, wherein said at least one chamfered edge extends at least partially into an adjacent recess, such that at least a part of an edge of the adjacent recess forming a driven surface of the plurality of driven surfaces of the of the adjacent recess is chamfered.

8. The internal cutting member according to claim 1, wherein said bottom surface is sloped in a radially inward direction toward the axis of rotation for guiding the coupling head radially inward with respect to the axis of rotation when applying an axial mounting force.

9. A cutting unit for a shaving apparatus, comprising an external cutting member and the internal cutting member according to claim 1, wherein the internal cutting member is configured to be driven into rotation with respect to the external cutting member about the axis of rotation.

10. A shaving apparatus provided with at least one cutting unit having external cutting member and an internal cutting member, the shaving apparatus comprising:

a drive mechanism for driving the internal cutting member into rotation; and a coupling for transferring a driving force from the drive mechanism to the internal cutting member, said coupling comprising a first coupling member having a coupling head and a second coupling member having a coupling cavity for receiving said coupling head to transfer said driving force inducing a driving torque about an axis of rotation of the internal cutting member, wherein said coupling head is detachably inserted into said coupling cavity and is detachable from said coupling cavity by a movement of said coupling head in relation to said coupling cavity in an axial direction parallel to the axis of rotation, wherein said coupling cavity has a plurality of driven surfaces, arranged to receive the driving force to induce the driving torque about the axis of rotation, wherein said coupling member has recesses, each recess of said recesses extending in a radial direction relative to the axis of rotation from said coupling cavity and being delimited by two side wall sections which each extends with a radial direction component with respect to the axis of rotation, wherein each of said two side wall sections of the each recess of said recesses forms an edge with a bottom surface of said coupling member, and wherein said edges of the each recess converge on each other in a radially outward direction in relation to said axis of rotation.

11. The shaving apparatus according to claim 10, wherein said coupling head comprises a plurality of drive surfaces for transmitting said driving force to said plurality of driven surfaces.

12. The shaving apparatus according to claim 11, wherein either said plurality of drive surfaces or said plurality of driven surfaces are curved to allow pivotal movement of the coupling head in said coupling cavity such that an axis of rotation associated with the first coupling member is in an angular displacement relative to the axis of rotation of the internal cutting member.

13. The shaving apparatus according to claim 10, wherein an upper face of said coupling head has a domed geometry.

14. An internal cutting member for a shaving apparatus, the internal cutting member having an axis of rotation and comprising:

a carrier;

cutter elements located at a circumference of the carrier; and a coupling member having a coupling cavity configured to detachably receive a coupling head of the shaving apparatus inside the coupling cavity, wherein the coupling member has recesses, each recess of the recesses being delimited by two side wall sections and extending in a radial direction relative to the axis of rotation, and wherein the two side wall sections that delimit the each recess are non-parallel to each other.

15. The internal cutting member of claim 14, wherein the two side wall sections of the each recess converge on each other in a radially outward direction in relation to the axis of rotation.

16. The internal cutting member of claim 14, wherein the coupling cavity has a plurality of driven surfaces configured to receive a driving force to induce a driving torque about the axis of rotation.

17. The internal cutting member of claim 14, wherein the coupling cavity has a cavity opening for receiving the coupling head by a movement of the coupling head in relation to the coupling cavity in an axial direction parallel to the axis of rotation.

18. The internal cutting member of claim 14, wherein the each recess has edges formed between a bottom surface of the coupling member and the two side wall sections, and wherein at least one of the edges of the each recess is chamfered to form at least one chamfered edge.

19. The internal cutting member of claim 18, wherein a chamfering of the at least one chamfered edge increases in a radially inward direction toward the axis of rotation.

20. The internal cutting member of claim 18, wherein the at least one chamfered edge extends at least partially into an adjacent recess.

* * * * *